US005116436A

United States Patent [19]

Nishimoto et al.

[11] Patent Number: 5,116,436

[45] Date of Patent: May 26, 1992

[54] METHOD OF MAKING NON-ORIENTED ELECTRICAL STEEL SHEETS HAVING EXCELLENT MAGNETIC PROPERTIES

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 476,508

[22] PCT Filed: Apr. 26, 1989

[86] PCT No.: PCT/JP89/00440

§ 371 Date: Jun. 13, 1990

§ 102(e) Date: Jun. 13, 1990

[87] PCT Pub. No.: WO90/12897

PCT Pub. Date: Nov. 1, 1990

[51] Int. Cl.[5] ..... H01F 1/04

[52] U.S. Cl. ..... 148/111

[58] Field of Search ..... 148/111, 112

[56] References Cited

U.S. PATENT DOCUMENTS 3,770,517 11/1973 Gray et al. ..... 148/112

FOREIGN PATENT DOCUMENTS 58-151453 9/1983 Japan .

58-171527 10/1983 Japan .

1-198426 8/1989 Japan ..... 148/111

1-198427 8/1989 Japan ..... 148/111

*Primary Examiner*—John P. Sheehan

*Attorney, Agent, or Firm*—Nields & Lemack

[57] ABSTRACT

Non-oriented electrical steel sheets having excellent magnetic properties are produced by carrying out a coiling at a low temperature for monitoring the amount of scale generation; de-scaling after hot rolling; and annealing the de-scaled hot rolled sheet in a non-oxidizing atmosphere to thereby minimize the oxidation and nitriding during annealing the hot rolled sheet. By determining a higher heating temperature for hot rolling, a magnetic property (magnetic flux density) is improved, and the hot rolled sheet is subjected to an open coil-annealing and annealing conditions therefor are specified in order to perfectly precipitate re-solute AlN particles by this heating and fully coarsen AlN particles.

2 Claims, 3 Drawing Sheets

Slab heating temperature : 1200 °C
Final annealing conditions : 950 °C x 2min
25 % $H_2$ + 75 % $N_2$
Dew point : -10 °C

METHOD OF MAKING NON-ORIENTED ELECTRICAL STEEL SHEETS HAVING EXCELLENT MAGNETIC PROPERTIES

TECHNICAL FIELD

This invention relates to a method of making non-oriented electrical steel sheets having excellent magnetic properties.

BACKGROUND OF THE INVENTION

If a steel blankwork containing more than 1% Si is hot rolled, generally the hot rolled sheet is recrystallized at the surface layer only, and the middle layer is composed of a rolled and non-recrystallized structure. If such a hot rolled sheet is cold rolled and annealed as it is, magnetic properties could not be provided, since a texture conducive to the magnetic properties develops insufficiently. For securing the magnetic properties after the cold rolling and annealing, the hot rolled structure should be perfectly recrystallized. For example, Japanese Patent Application Laid Open Specifications No. 68717/79 or No. 97426/80, aiming at such objects, disclose annealings of the hot rolled sheet by a batch annealing or a continuous annealing after hot rolling and coiling.

In the annealing of the hot rolled sheet as such, if the recrystallization treatment is carried out on the hot rolled sheet, scales remain on the surface thereof, and if the annealing is done in an insufficient non-oxidizing atmosphere, the scales develop and grow thick, and internal oxidized layers grow in the steel surface layer so that a pickling ability after the treatment is markedly deteriorated. On the other hand, in spite of the non-oxidizing atmosphere, if the annealing is done in an atmosphere containing nitrogen, a nitriding reaction is accelerated in the steel surface layer, and it combines Al in the steel and brings about precipitations of AlN in the steel surface layer. Therefore, AlN particles considerably lower ferrite grain growth in a final annealing. As a result, the steel surface layer is formed with regions of fine ferrite grains of about 20 μm in thickness of about 100 μm, and remarkably deteriorate properties of iron losses and magnetic properties in low magnetic fields.

In view of these circumstances, Japanese Patent Application Laid Open Specification No. 35627/82 discloses the art of performing the pickling after the coiling at high temperature and subsequently batch annealing. However, at coiling temperatures of higher than 700° C., not only does the scale on the surface grow thick, but also oxidation is caused in the ferrite grains, if Si is more than 1 wt %. The oxidized layer in the ferrite grain cannot be perfectly removed by the pickling before the annealing of the hot rolled sheet, and the magnetic properties are deteriorated as stated above.

Further, in the annealing of the hot rolled sheet, it is necessary to perfectly precipitate AlN for satisfactory ferrite grain growth at a final annealing, and coarsen the precipitated AlN for which a soaking time should be taken sufficiently in the annealing. If the soaking time is short and the coasening of AlN particles is insufficient, the grain growth at the final annealing is spoiled by the inhibiting effect of movements of the grain boundaries due to AlN particles.

DISCLOSURE OF THE INVENTION

Taking these problems into consideration, it is an object of the invention to provide a method of making non-oriented electrical steel sheets having excellent magnetic properties.

For accomplishing this object, the invention passes the steel of specific chemical composition through the following steps so as to cause the ferrite grains to grow satisfactorily in the final annealing for providing the non-oriented electrical steel sheets having excellent magnetic properties.

1) The coiling is carried out at the low temperature for checking the amount of scale generation, and a descaling is perfectly done after the hot rolling. The descaled hot rolled sheet is annealed in a non-oxidizing atmosphere, thereby minimizing the oxidation and the nitriding during annealing the hot rolled sheet.

2) By determining a higher heating temperature for hot rolling, a magnetic property (a magnetic flux density) is improved and the hot rolled sheet is subjected to an open coil-annealing and annealing conditions therefor are specified in order to perfectly precipitate resolute AlN particles by this heating and fully coarsen AlN particles thereof.

That is, the invention is basically characterized by heating a slab containing C: not more than 0.0050 wt %, Si: 1.0 to 4.0 wt %, Al: 0.1 to 2.0 wt %, the rest being Fe and unavoidable impurities, to temperatures between higher than 1150° C. and not higher than 1250° C.; hot rolling; coiling at temperatures of not higher than 700° C.; de-scaling; subsequently open coil-annealing the hot rolled sheet at a relation between temperature of 750° to 900° C. and the soaking time t (min.), in a non-oxidizing atmosphere and under conditions satisfying $$T \geqq -128.5 \log t + 1078.5;$$

carrying out one cold-rolling or plural cold rollings having interposed therebetween an intermediate annealing, and final-annealing at temperatures between 800° and 1050° C.

DETAILED DESCRIPTION OF THE INVENTION

Steel making conditions of the invention will be explained together with limiting reasons therefor.

A slab to be hot rolled is composed of C: not more than 0.0050 wt %, Si: 1.0 to 4.0 wt %, Al: 0.1 to 2.0 wt % the rest being Fe and unavoidable impurities.

If the carbon content exceeds 0.0050 wt %, the magnetic properties are deteriorated, and problems arise regarding magnetic aging. Therefore, the upper limit is determined to be 0.0050 wt %.

If the silicon content is less than 1.0 wt %, the values of low iron loss cannot be satisfied by lowering a specific resistance. If it is more than 4.0 wt %, a cold workability is considerably worsened. Therefore, the silicon content is determined to be 1.0 to 4.0 wt %.

If the aluminum content is less than 0.1 wt %, fine precipitation of AlN is caused, and the grain growth suitable to the final annealing can not be obtained so that the magnetic properties are deteriorated. But if it is more than 2.0 wt %, the cold workability is decreased. Thus, the Al content is 0.1 to 2.0 wt %.

The slab of the above mentioned chemical composition is heated to temperatures between 1150° and 1250° C. and hot-rolled. If the heating temperature is increased, not only is the uniformity of the steel material heightened by setting the high finishing temperature and others, but the magnetic flux density is improved. If the heating is low, the finishing temperature of the hot rolling is decreased to increase a mill load so that it is difficult to maintain hot rolled shapes. For these reasons, the lower limit of the heating temperature is determined to be 1150° C.

In addition, if the slab heating temperature exceeds 1250° C., the resolution of AlN advances and the scales on the slab surface become molten and worsen the surface qualities of the hot rolled sheet.

Figure 1:
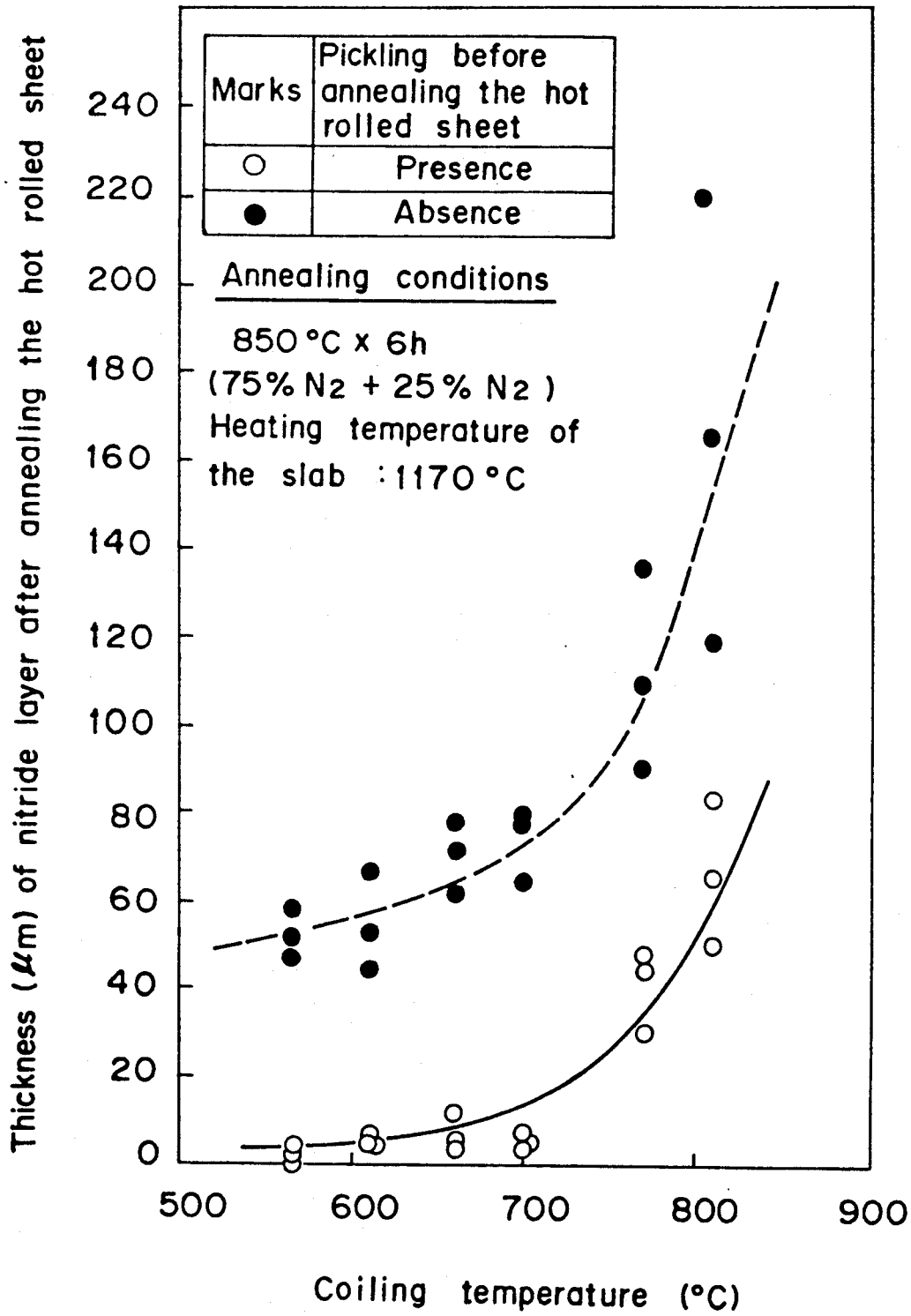
FIG. 1 shows influences of hot rolling and coiling temperatures to the thickness of the nitriding layer after annealing the hot rolled sheet.

One of the most important technologies of the invention is to coil the hot rolled sheet at the temperature of lower than 700° C. after hot rolling. If the coiling temperature is higher than 700° C., the scale grows thick on the surface of the hot rolled sheet. Even if the descaling such as pickling is carried out before the annealing of the hot rolled sheet, the scale on the steel surface will be removed, but it is difficult to remove the internal oxidized layer formed in high Si steel. As later mentioned, if the scale remains when annealing the hot rolled sheet, the nitriding reaction is accelerated due to the scale as a catalyzer so that the precipitated layer of AlN is formed under the surface layer of the steel sheet. As a result, the grain growth therein is checked at the final annealing to invite increasing of the iron loss. FIG. 1 shows the relation between the coiling temperature and the thickness of the nitride layer after the annealing of the hot rolled sheet, and if the coiling temperature is higher than 700° C., it is seen that the nitriding reaction is largely accelerated by the remaining scales.

Another important aspect of the invention is that the hot rolled sheet is performed with the de-scaling treatment before the subsequent annealing. If the annealing is carried out in the non-oxidizing atmosphere containing nitrogen as the scales remain on the surface, the nitriding reaction is accelerated in the steel surface layer to increase the nitrogen content. Therefore, the fine AlN particles considerably lower the grain growth of ferrite at the final annealing and form thick layers of fine ferrite grains in the steel surface so as to much deteriorate the iron loss and magnetic characteristics of the low magnetic field. Thus, the present invention aims at checking the nitriding reaction by removing the scales before the annealing of the hot rolled sheet.

The de-scaling is normally carried out by the pickling, but may depend upon mechanical treatments, and no limit is made to actual manner used. In the invention, since the scale is checked to be small by the low temperature coiling, it is possible to almost perfectly remove the scale by said de-scaling.

The hot rolled sheet is open coil-annealed after de-scaling in the non-oxidizing atmosphere under the condition satisfying $$T \geqq -128.5 \log t + 1078.5$$

in the relation between the annealing temperature T (°C.) of 750° to 900° C. and the soaking time t (min).

As stated above, with respect to the blankwork containing more than 1 wt % silicon, the hot rolled sheet is recrystallized at parts of the surface only, and the middle layer is composed of the rolled and non-recrystallized structure. Therefore, if the hot rolled sheet is cold rolled and annealed as it is, the magnetic properties could not be provided securely. For improving the magnetic properties after the final annealing and keeping it uniform, it is necessary to provide recrystallization uniform in the thickness, width and length of the coil. There is a close relation between the value of the iron loss and the ferrite grain size after the final annealing, and when the ferrite grain size is around 100 to 150 μm, the value of the iron loss is the minimum. Thus, for satisfying the growth of the ferrite grain at the final annealing, AlN must be perfectly precipitated at annealing the hot rolled sheet, and they (or AlN particles) must be coarsened, since the inhibiting effect of the movement of the grain boundaries is decreased.

The annealing of the hot rolled sheet is the open coil-annealing. In the invention, it is necessary to take a longer annealing time and if a continuous annealing is performed, a line speed should be lowered extraordinarily, and this is inefficient. If depending upon a batch annealing, and in a case of a tight coil, heating histories are different in the inner part and the outer part of the coil, and uniform magnetic properties could not be provided in the length and width of the coil.

If the soaking temperature is less than 750° C., it requires soaking for more than 5 hours for perfectly recrystallizing the hot rolled sheet inefficiently. On the other hand, if the soaking temperature is higher than 900° C., the velocity of the ferrite grain boundary movement is high after the recrystallization of the hot rolled sheet. So, when AlN particles are coarsened, the ferrite grains become more than 500 μm, so that the cold workability is inferior in a subsequent process, and the surface qualities after the cold rolling are deteriorated.

For decreasing the value of the iron loss, it is necessary to fully coarsen AlN particles by annealing the hot rolled sheet, and since the recrystallization in the annealing of the hot rolled sheet is accomplished earlier than coarsening of AlN particles, the latter is the greatest target in the annealing of the hot rolled sheet. The time necessary to accomplish said coarsening is varied depending upon the heating temperatures of the slab. The more the re-solving amount, during heating the slab, of coarse AlN particles precipitated during cooling after solidifying the cast slab, the longer becomes the accomplishing time for coarsening AlN particles during annealing the hot rolled sheet.

Figure 2:
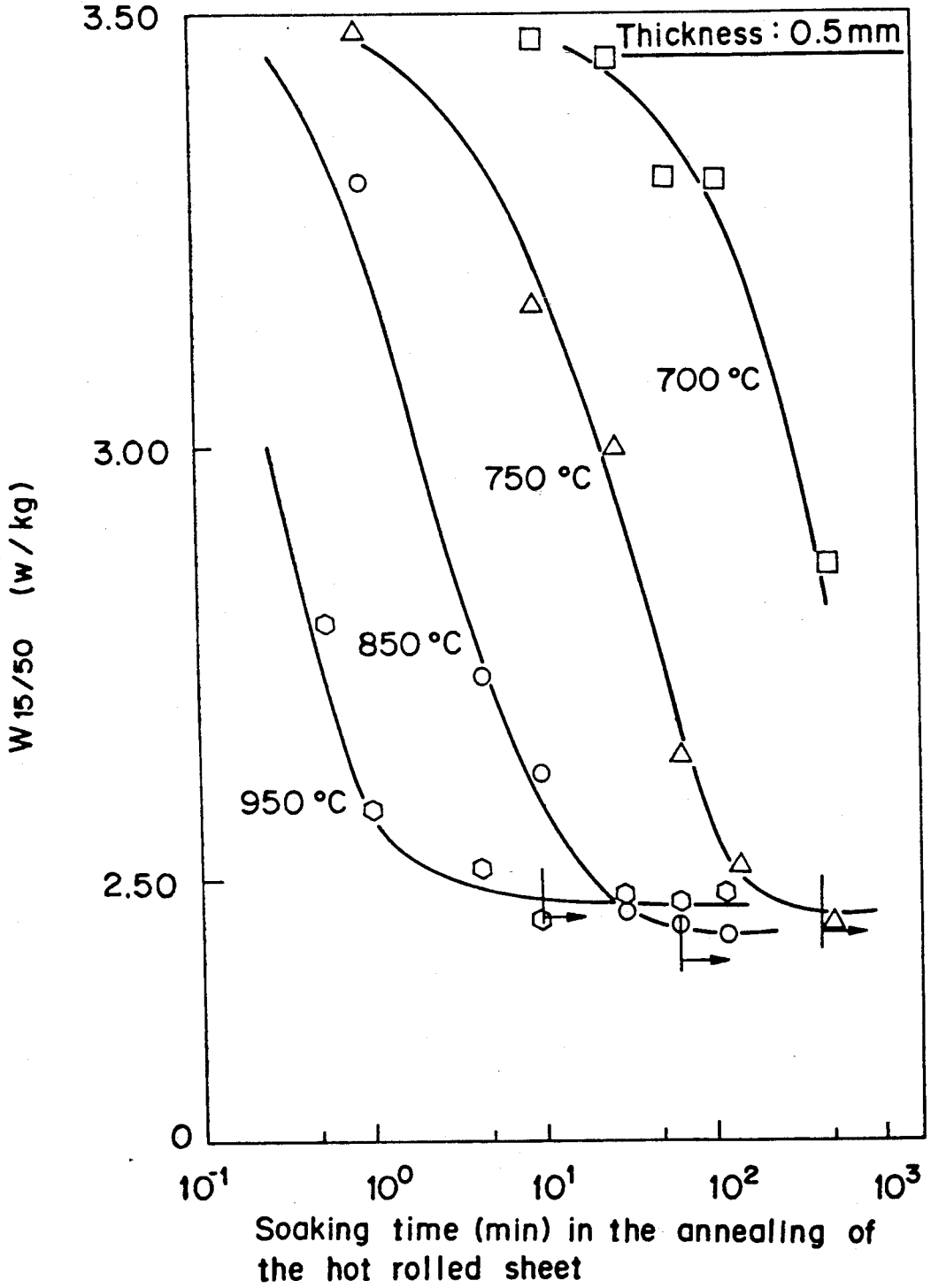
FIG. 2 shows influences of soaking temperature and soaking time in annealing the hot rolled sheet to the magnetic properties after the final annealing.
Figure 3:
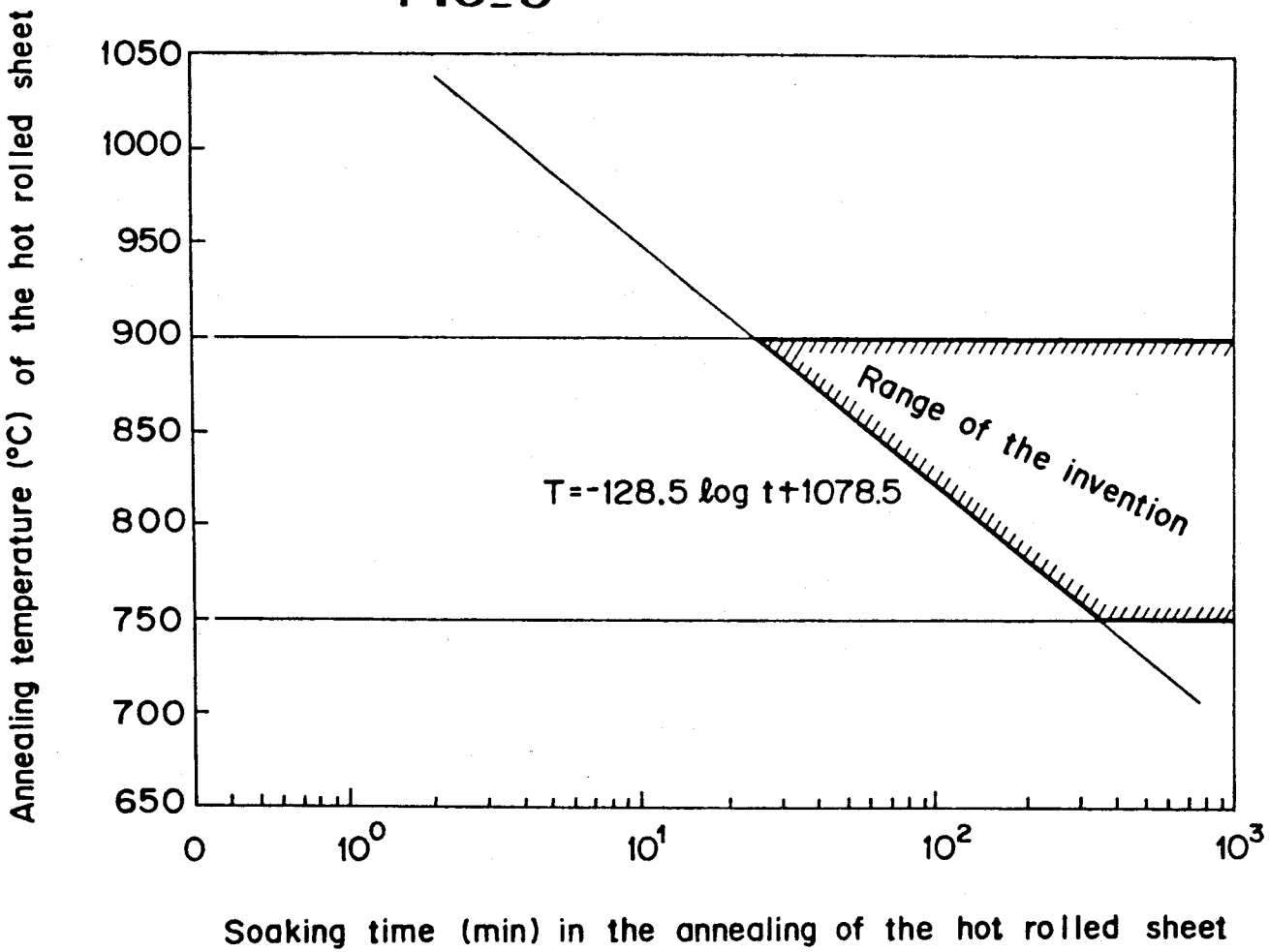
FIG. 3 shows annealing conditions of the hot rolled sheet in the invention.

FIG. 2 shows the influences of the soaking temperature and time and the annealing of the hot rolled sheet to the magnetic properties after the final annealing. FIG. 3 summarizes the soaking conditions in reference to the results of FIG. 2. According to this, the soaking condition depends upon the relation between the soaking temperature and time. That is, for coarsening the particles of the hot rolled sheet, it is necessary to satisfy the condition of $$T \geqq -128.5 \log t + 1078.5.$$

The hot rolled sheet is annealed in the non-oxidizing atmosphere for avoiding the formation of the scales accelerating the nitriding. For example, it is desirable to perform the annealing in an atmosphere containing mixture of nitrogen-hydrogen of more than 5% $H_2$.

The steel sheet annealed as above is, if required, subjected to the pickling, and to one cold rolling or plural cold rollings having interposed therebetween the intermediate annealing, and subsequently to the final annealing at the temperature of 800° to 1050° C.

If the soaking temperature in the final annealing is less than 800° C., the iron loss and a magnetic flux density the invention aims at cannot be improved enough, but if it is higher than 1050° C., it is not practical in view of running of the coil and the cost of energy. Further, in the magnetic properties, the value of the iron loss increases by an abnormal growth of the ferrite grains.

EXAMPLE 1

The non-oriented electrical steel sheets were produced from the steel materials of the chemical compositions of Table 1 under following conditions. Table 2 shows the magnetic properties after the final annealings.

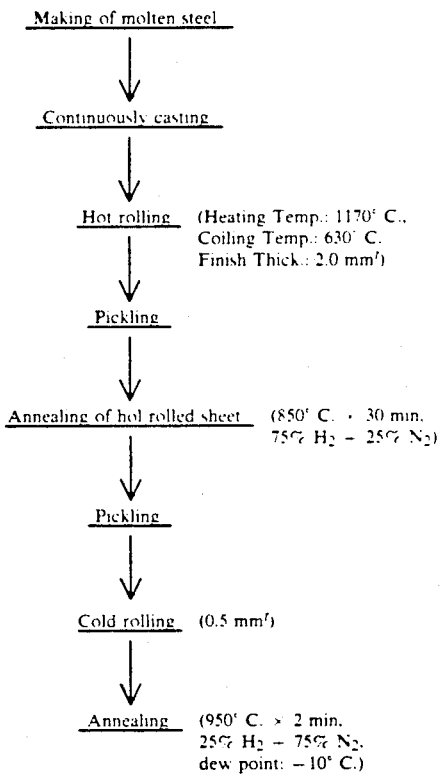

TABLE 1

(wt %)

| Samples | C | Si | Mn | P | S | Sol.Al | N | — |
|---|---|---|---|---|---|---|---|---|
| A | 0.0026 | 3.04 | 0.17 | 0.005 | 0.003 | 0.02 | 0.0034 | Comparative Steel |
| B | 0.0028 | 3.06 | 0.18 | 0.005 | 0.003 | 0.53 | 0.0028 | Inventive Steel |
| C | 0.0029 | 1.73 | 0.17 | 0.004 | 0.003 | 0.31 | 0.0031 | Inventive Steel |
| D | 0.0026 | 1.71 | 0.17 | 0.005 | 0.003 | 0.03 | 0.0035 | Comparative Steel |

TABLE 2

| Samples | $W_{15/50}$ (W/Kg) | $B_{50}$ (T) |
|---|---|---|
| A | 3.41 | 1.664 |
| B | 2.45 | 1.683 |
| C | 3.53 | 1.713 |
| D | 4.16 | 1.705 |

Magnetic properties were measured by the 25 cm Epstein testing apparatus

EXAMPLE 2

The non-oriented electrical steel sheets were produced from the steel material B of Table 1 under following conditions and conditions of Table 3. Table 3 shows the heating temperatures of the produced steel sheets.

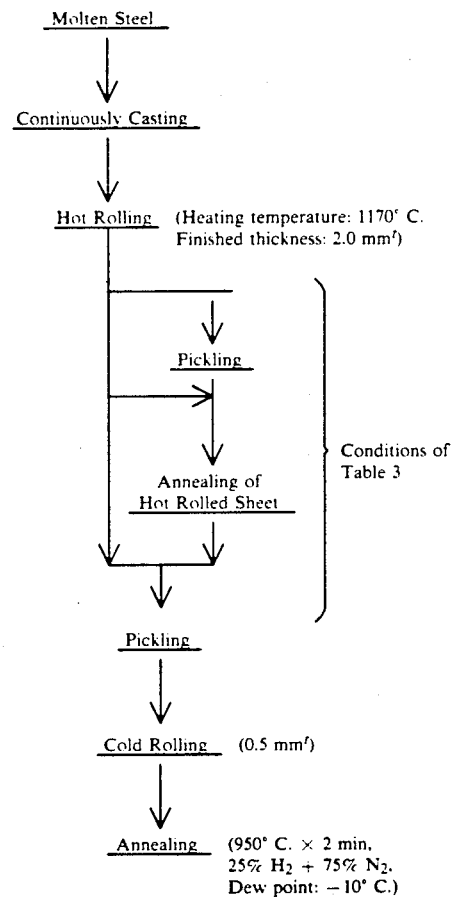

TABLE 3

| Sample No. | — | Coiling Temp. | Pickling | Annealing of hot rolled sheets: Soaking conditions | Annealing of hot rolled sheets: Atmosphere | Magnetic properties: $W_{15/50}$ | Magnetic properties: $B_{50}$ |
|---|---|---|---|---|---|---|---|
| 1 | Present example | 630° C. | Yes | 850° C. × 3 h | 75% $H_2$ + 25% $N_2$ | 2.45 (T) | 1.683 (W/Kg) |
| 2 | Comparative example | 630° C. | Non | 850° C. × 3 h | 75% $H_2$ + 25% $N_2$ | 3.28 | 1.678 |

TABLE 3-continued

| Sample No | — | Coiling Temp | Pickling | Annealing of hot rolled sheets: Soaking conditions | Annealing of hot rolled sheets: Atmosphere | Magnetic properties: $W_{15/50}$ | Magnetic properties: $B_{50}$ |
|---|---|---|---|---|---|---|---|
| 3 | Comparative example | 770° C. | Yes | 850° C. × 3 h | 75% $H_2$ + 25% $N_2$ | 3.57 | 1.675 |
| 4 | Comparative example | 770° C. | Non | 850° C. × 3 h | 75% $H_2$ + 25% $N_2$ | 3.83 | 1.670 |
| 5 | Comparative example | 630° C. | Yes | 800° C. × 10 min | 10% $H_2$ + $N_2$ | 3.06 | 1.657 |
| 6 | Comparative example | 630° C. | Yes | 850° C. × 1 h | $N_2$ | 3.35 | 1.672 |
| 7 | Comparative example | 630° C. | Yes | 700° C. × 10 h | 75% $H_2$ + 25% $N_2$ | 3.12 | 1.642 |
| 8 | Comparative example | 630° C. | Yes | — | — | 3.44 | 1.624 |
| 9 | Comparative example | 820° C. | Yes | — | — | 3.41 | 1.661 |

Magnetic properties were measured by the 25 cm Epstein testing apparatus

INDUSTRIAL APPLICABILITY

The present invention may be applied to a method of making non-oriented electrical steel sheet having excellent magnetic properties.

What is claimed is:

1. A method of making non-oriented electrical steel sheet having excellent magnetic properties, comprising:

a) heating a slab containing C: not more than 0.0050 wt %, Si: 1.0 to 4.0 wt %, Al: 0.1 to 2.0 wt %, the rest being Fe and unavoidable impurities, to temperatures between higher than 1150° C. and not higher than 1250° C.;

b) hot rolling said slab so as to form a hot rolled sheet;

c) coiling said hot rolled sheet at temperatures of not more than 700° C.;

d) de-scaling said hot rolled sheet;

e) subsequently open-annealing the hot rolled sheet at a relation between temperature (°C) of 750° to 900° C. and the soaking time t (min.), in a non-oxidizing atmosphere and under conditions satisfying the following:

$$T \geqq -128.5 \log t + 1078.5;$$

f) carrying out a cold rolling or plural cold rollings having interposed therebetween an intermediate annealing;

g) and finish-annealing at temperatures between 800° and 1050° C.

2. A method as claimed in claim 1, wherein said open-annealing of the hot rolled steel sheet is carried out in an atmosphere containing a mixture of Nitrogen-Hydrogen of more than 5% $H_2$.

* * * * *